US009584910B2

(12) United States Patent
Wilson

(10) Patent No.: US 9,584,910 B2
(45) Date of Patent: Feb. 28, 2017

(54) SOUND GATHERING SYSTEM

(71) Applicant: Steelcase Inc., Grand Rapids, MI (US)

(72) Inventor: Scott Edward Wilson, Byron Center, MI (US)

(73) Assignee: Steelcase Inc., Grand Rapids, MI (US)

( * ) Notice: Subject to any disclaimer, the term of this patent is extended or adjusted under 35 U.S.C. 154(b) by 124 days.

(21) Appl. No.: 14/573,705

(22) Filed: Dec. 17, 2014

(65) Prior Publication Data

US 2016/0182997 A1 Jun. 23, 2016

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01)

(58) Field of Classification Search
CPC ..... H04R 3/005; H04R 1/406
See application file for complete search history.

(56) References Cited

U.S. PATENT DOCUMENTS 4,131,760 A 12/1978 Christensen et al.
4,559,642 A 12/1985 Miyaji et al.
5,400,409 A 3/1995 Linhard
5,581,620 A 12/1996 Brandstein et al.
5,787,183 A 7/1998 Chu et al.
6,421,448 B1 7/2002 Arndt et al.
6,430,295 B1 8/2002 Handel et al.
6,529,869 B1 3/2003 Wietzke et al.
6,757,394 B2 6/2004 Matsuo
6,912,178 B2 6/2005 Chu et al.
7,035,416 B2 4/2006 Matsuo
7,203,323 B2 4/2007 Tashev
7,254,241 B2 8/2007 Rui et al.
7,313,243 B2 12/2007 Hsu
7,460,677 B1 12/2008 Soede et al.
7,561,701 B2 7/2009 Fischer
7,630,503 B2 12/2009 Schulz et al.
7,764,801 B2 7/2010 Soede et al.
7,787,328 B2 8/2010 Chu et al.
7,817,805 B1 10/2010 Griffin
7,970,152 B2 6/2011 Fischer et al.
7,991,168 B2 8/2011 Wu et al.
8,150,065 B2 4/2012 Solbach et al.
8,218,787 B2 7/2012 Kushida
8,219,387 B2 7/2012 Cutler et al.
8,233,353 B2 7/2012 Zhang et al.
8,238,573 B2 8/2012 Ishibashi et al.
8,243,952 B2 8/2012 Thormundsson et al.
(Continued)

*Primary Examiner* — Regina N Holder
(74) *Attorney, Agent, or Firm* — Price Heneveld LLP

(57) ABSTRACT

A sound gathering system is disclosed herein and includes a plurality of microphones each configured to sample sound coming from a sound source. A plurality of processors are arranged in a processor chain. Each processor is coupled to at least one of the microphones and is configured to store sound samples received from the at least one microphone to a memory. A controller is terminally connected to the processor chain via a first processor. The controller is configured to calculate at least one time delay for each microphone, wherein the at least one time delay for each microphone is provided to the processor coupled thereto and is used by the processor to determine a memory position from which to begin reading sound samples.

20 Claims, 16 Drawing Sheets

(56) References Cited

U.S. PATENT DOCUMENTS

| | | | | |
|---|---|---|---|---|
| 8,526,633 | B2 | 9/2013 | Ukai et al. | |
| 8,559,611 | B2 | 10/2013 | Ratmanski et al. | |
| 9,479,866 | B2 * | 10/2016 | Adams | H04R 3/005 |
| 2006/0013416 | A1 | 1/2006 | Truong et al. | |
| 2010/0150364 | A1 * | 6/2010 | Buck | G01S 3/807 381/66 |
| 2013/0029684 | A1 | 1/2013 | Kawaguchi et al. | |
| 2013/0051577 | A1 | 2/2013 | Morcelli et al. | |
| 2013/0142355 | A1 | 6/2013 | Isaac et al. | |
| 2013/0142356 | A1 | 6/2013 | Isaac et al. | |

* cited by examiner

SOUND GATHERING SYSTEM

FIELD OF THE INVENTION

The present invention generally relates to sound gathering systems, and more particularly, to sound gathering systems employing microphone arrays.

BACKGROUND OF THE INVENTION

The subject matter disclosed herein is directed to a sound gathering system that benefits from advantageous design and implementation.

SUMMARY OF THE INVENTION

According to one aspect of the present invention, a sound gathering system is provided and includes a plurality of microphones each configured to sample sound coming from a sound source. A plurality of processors are arranged in a processor chain. Each processor is coupled to at least one of the microphones and is configured to store sound samples received from the at least one microphone to a memory. A controller is terminally connected to the processor chain via a first processor. The controller is configured to calculate at least one time delay for each microphone, wherein the at least one time delay for each microphone is provided to the processor coupled thereto and is used by the processor to determine a memory position from which to begin reading sound samples.

According to another aspect of the present invention, a sound gathering system is provided and includes a plurality of microphones, each configured to sample sound coming from a sound source. A processor chain includes a plurality of processors, each coupled to at least one of the microphones and each configured to store sound samples received from the at least one microphone to a memory. A controller is terminally connected to the processor chain via a first processor, the controller configured to generate a time delay instruction containing a plurality of time delays that are each associated with one of the microphones. The time delay instruction is provided to each of the processors over a first channel. Each processor removes at least one time delay from the time delay instruction and determines a memory position from which to begin reading sound samples based on the at least one time delay. The sound samples read from the memory of each processor are summed together over a second channel to generate in-phase signals that are sent to the controller.

According to yet another aspect of the present invention, a method of gathering sound is provided and includes the steps of sampling sound coming from a sound source using a plurality of microphones; arranging a plurality of processors in a processor chain, each processor coupled to at least one of the microphones and each configured to store sound samples received from the at least one microphone to a memory; terminally connecting a controller to the processor chain via a first processor and using the controller to generate a time delay instruction containing a plurality of time delays that are each associated with one of the microphones; providing the time delay instruction to each of the processors over a first channel; removing with each processor at least one time delay from the time delay instruction and determining a memory position from which to begin reading sound samples based on the at least one time delay; and summing together sound samples read from the memory of each processor over a second channel to generate in-phase signals that are sent to the controller.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present invention are disclosed herein. However, it is to be understood that the disclosed embodiments are merely exemplary of the invention that may be embodied in various and alternative forms. The figures are not necessarily to a detailed design and some schematics may be exaggerated or minimized to show function overview. Therefore, specific structural and functional details disclosed herein are not to be interpreted as limiting, but merely as a representative basis for teaching one skilled in the art to variously employ the present invention.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Figure 1:
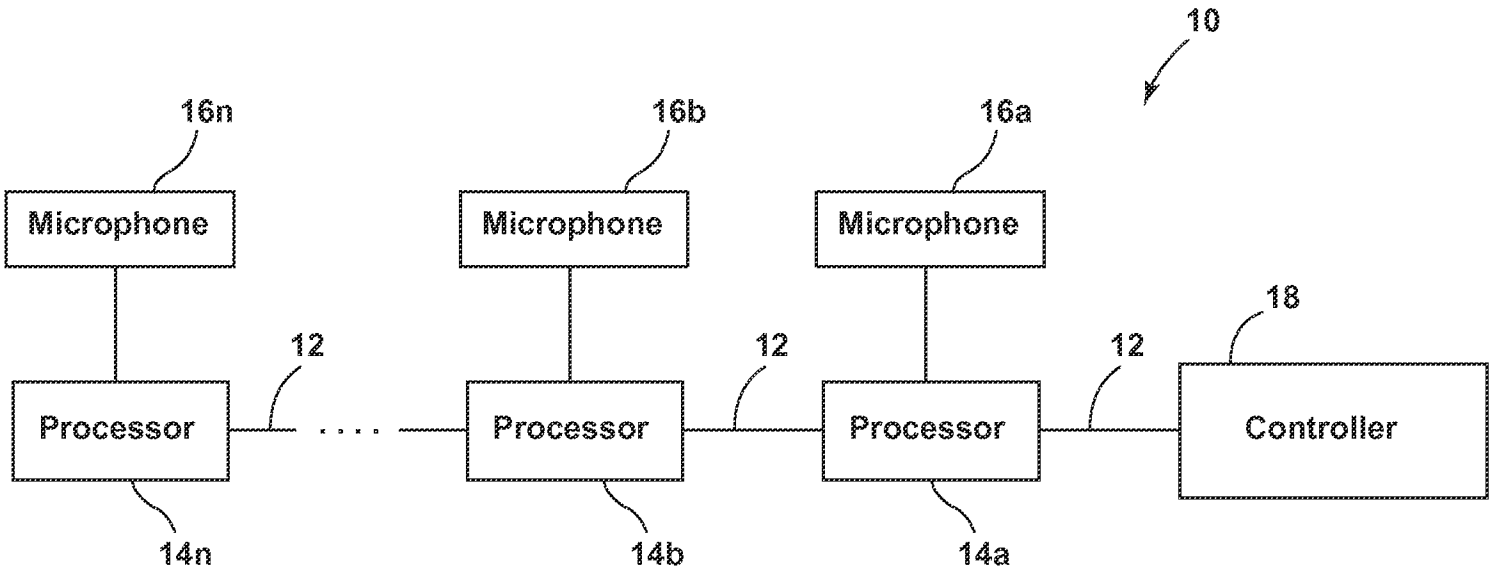
FIG. 1 is a block diagram of a sound gathering system according to one embodiment.
Figure 2:
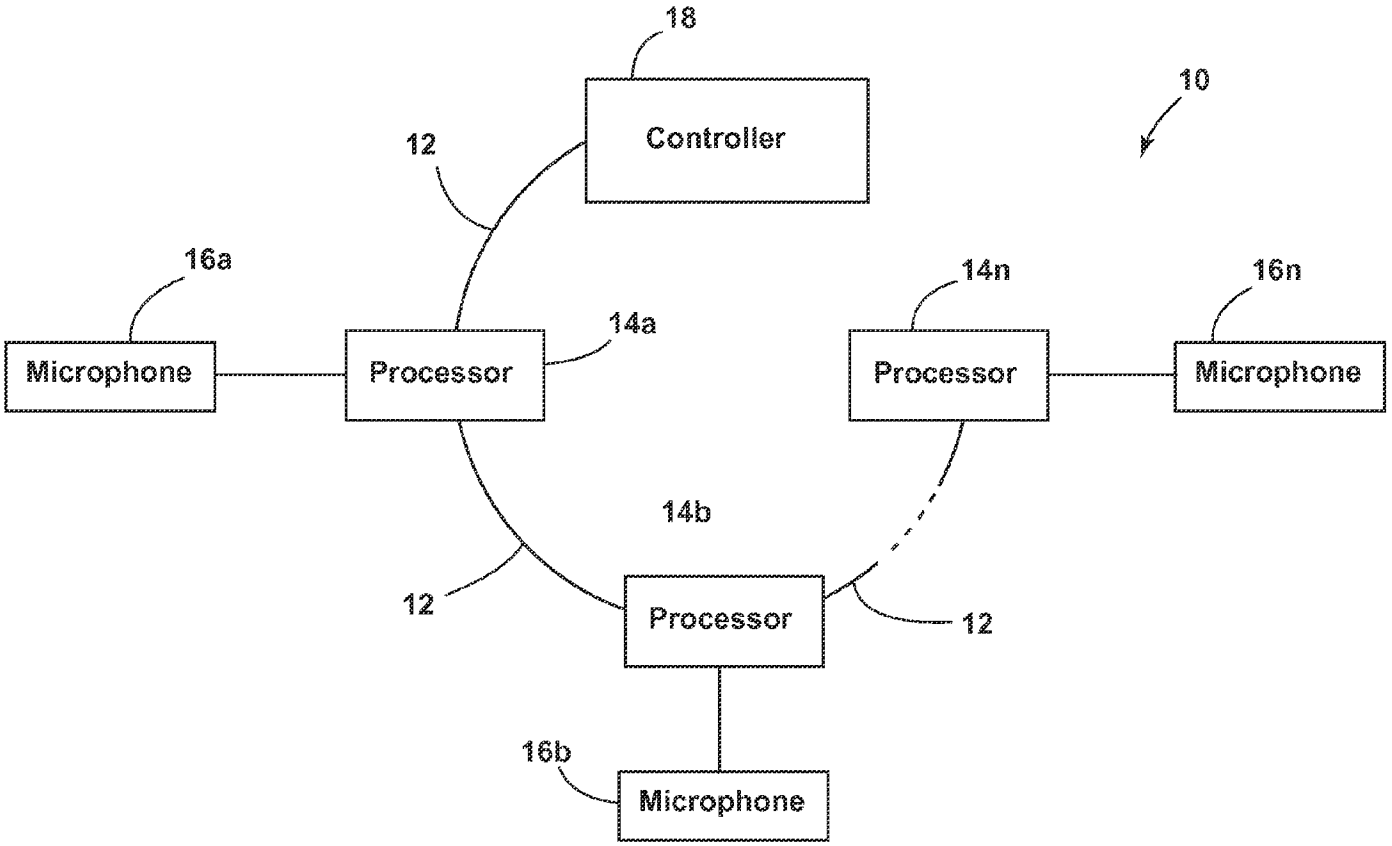
FIG. 2 is a block diagram of a sound gathering system according to another embodiment.

Referring to FIG. 1, a sound gathering system 10 is generally shown. The system 10 includes a processor chain 12 comprising processors 14*a*-14*n*, each of which is coupled to at least one microphone 16*a*-16*n*. A controller 18 is terminally coupled to the processor chain 12 via an end processor such as processor 14*a* or may be terminally coupled to the nth processor 14*n* in other embodiments. With respect to the disclosure provided herein, the end processor to which the controller 18 is coupled is referred to as "the first processor" while the other end processor is referred to as "the last processor" by virtue of their positions in the processor chain 12 relative to the controller 18. Thus, it can be said that the first processor occupies a position in the processor chain 12 that is closest to the controller 18 whereas the last processor occupies a position in the processor chain 12 that is farthest from the controller 18. It is to be understood that the position of a given processor 14*a*-14*n* in the processor chain 12 does not necessarily correlate with physical distance from the controller 18. Although the last processor, processor 14*n*, is shown in FIG. 1 as having the farthest physical distance from the controller 18, the processor chain 12 may be otherwise arranged such that processor 14*n* is not the most remote in distance to the controller 18, as is exemplarily shown in FIG. 2. Thus, the position of a given processor 14*a*-14*n* in the processor chain 12 will remain constant while the physical distance of the processor 14*a*-14*n* from the controller 18 may vary depending on the particular configuration and number of processors in the processor chain 12.

Figure 3:
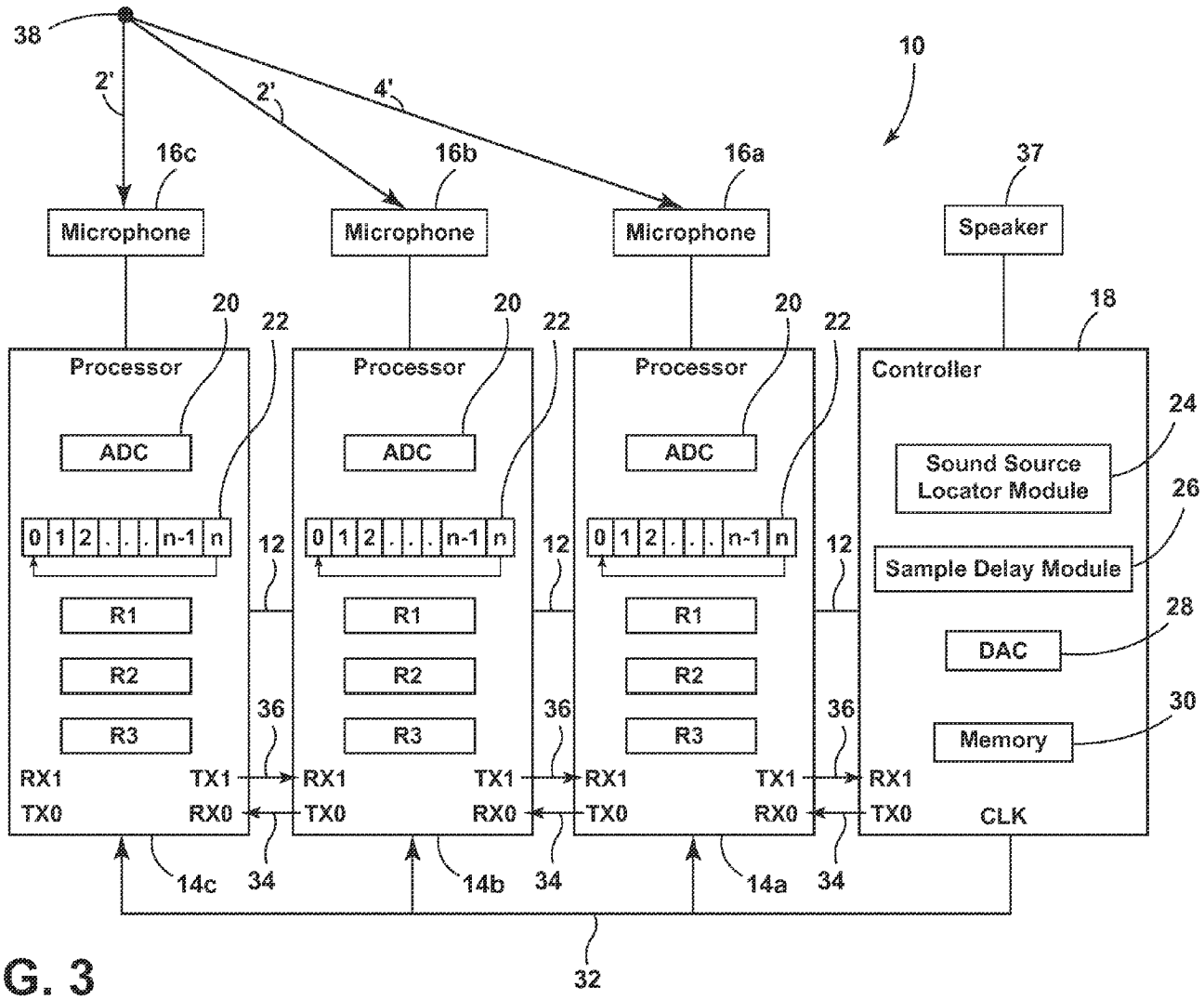
FIG. 3 is a block diagram of a sound gathering system according to yet another embodiment.

Referring to FIG. 3, the sound gathering system 10 is shown in greater detail according to one embodiment. For simplicity, the system 10 includes a three-processor chain 12 comprising processors 14*a*-14*c*. Each processor 14*a*-14*c* is coupled to a corresponding microphone 16*a*-16*c* and includes an analog to digital converter (ADC) 20, a memory, shown as a ring buffer 22 having a predefined length n, and one or more registers, exemplarily shown as a first register R1 R1, a second register R2 R2, and a third register R3. A controller 18 is terminally coupled to the processor chain 12 via processor 14*a* and includes a sound source locator module 24, a time delay module 26, a digital to analog converter DAC 28, and a memory 30. The processors 14*a*-14*c* can be synched together via a sync line 32 controlled by a clock CLK of the controller 18. Communication between the processors 14*a*-14*c* and the controller 18 can occur over a first channel referred to herein as "channel_0" and a second channel referred to herein as "channel_1". Channel_0 includes a plurality of universal asynchronous receivers RX0 and transmitters TX0 arranged to allow unidirectional data transfer from the controller 18 to processor 14*a*, from processor 14*a* to processor 14*b*, and from processor 14*b* to processor 14*c*, as shown by arrows 34. In contrast, channel_1 includes a plurality of universal asynchronous receivers RX1 and transmitters TX1 arranged to allow unidirectional data transfer from processor 14*c* to processor 14*b*, from processor 14*b* to processor 14*a*, and from processor 14*a* to the controller 18, as shown by arrows 36. According to one embodiment, the controller 18 can also communicate with a speaker 37 37 or other sound-emitting device. The speaker 37 may be part of a conferencing system that is configured for teleconferencing, videoconferencing, web conferencing, the like, or a combination thereof.

In operation, the microphones 16*a*-16*c* are each configured to sample sound coming from a sound source, exemplarily shown in FIG. 3 as sound source 38. The sound samples obtained by the microphones 16*a*-16*c* each correspond to a discrete analog signal and are supplied to the corresponding processor 14*a*-14*c* to be digitized by the ADC 20 and stored in turn to the ring buffer 22. Specifically, each sound sample is written to a distinct address block numbered 0 to n. The address block to which a given sound sample is written is selected based on the position of an unsigned write pointer and the number of address blocks corresponds to the length of the ring buffer 22. According to one embodiment, the ADC 20 provides 12-bit precision and the ring buffer 22 is an overwriting buffer having a length of 256 (n=255). In this configuration, up to 256 12-bit sound samples can be stored to the ring buffer 22 at a time. When the ring buffer 22 becomes full, that is, when a sound sample has been written to each address block, subsequent sound samples received from the ADC 20 can be stored to the ring buffer 22 by overwriting the oldest data. For example, if sound samples are stored to the ring buffer 22 beginning with address block 0, the ring buffer 22 will become full once a sound sample is written to address block 255. In response, the write pointer will loop to address block 0 and overwrite its contents with the next sound sample, followed by blocks 1, 2, 3, and so on. The write pointer will continue to loop around in this manner so long as sound samples continue to be read from the ADC 20.

While the above-described sampling process is underway, the controller 18 is tasked with determining the location of the sound source 38 relative to each microphone 16*a*-16*c* using the sound source locator module 24. The sound source locator module 24 can employ any known sound locating method(s) for determining the location of the sound source 38 such as, but not limited to, sound triangulation. Once the location of the sound source 38 is known, the distance between the sound source 38 and each microphone 16*a*-16*c* can be determined. As is exemplarily shown in FIG. 3, the sound source 38 is separated from microphones 16*a*, 16*b* and 16*c* by distances of 4 feet, 2 feet, and 1 foot, respectively. It is to be understood that the location of the sound source 38 relative to the microphones 16*a*-16*c* along with the associated distances therebetween have been chosen arbitrarily and are provided herein for purposes of illustration.

Having found the distances between the sound source 38 and each microphone 16*a*-16*c*, the controller 18 calculates a time delay for each microphone 16*a*-16*c*. As will be described in greater detail below, the time delays are transmitted to the corresponding processors 14*a*-14*c* and indicate a starting address block of the ring buffer 22 from which to begin reading sound samples. The time delay for any given microphone 16*a*-16*c* is calculated based on the distance between the sound source 38 and the microphone located furthest from the sound source 38 (e.g., microphone 16*c*), the distance between the sound source 38 and the given microphone 16*a*-16*c*, a sampling rate of the given microphone 16*a*-16*c*, and the speed of sound. The general equation for calculating the time delay for a given microphone is as follows:

$$S_d=(D_1-D_2)*S_r/C$$

where $S_d$ is the time delay and is expressed as an integer value;

$D_1$ is the distance between the sound source and the microphone located furthest from the sound source;

$D_2$ is the distance between the sound source and the given microphone;

$S_r$ is the sampling rate of the given microphone; and

C is the speed of sound.

Solving the above equation for microphones 16*a*-16*c* returns a time delay of 0 for microphone 16*a*, a time delay of 35 for microphone 16*b*, and a time delay of 53 for microphone 16*c*, where the sampling rate S was chosen as 20,000 samples per second and the speed of sound C was chosen to be 1125 feet per second, which is approximately the speed of sound in dry air. From the above equation, it becomes apparent that the time delay for a microphone located furthest from a sound source will generally have a time delay of 0 whereas the time delay for the remaining microphones will generally increase the closer the microphone is to the sound source 38. Thus, once the time delays are implemented, as will be described below, sound samples read from the ring buffers 22 of each processor 14*a*-14*c* will be phased according to the microphone that is furthest located from the sound source 38. For simplicity, the above-calculated time delays are each expressed as unrounded integer values. However, in other embodiments, the time delays can be rounded up or down if desired.

The time delays can each be packaged as a byte in a time delay instruction that is transmitted from the controller 18 to each of the processors 14*a*-14*c*. The time delay instruction is transmitted over channel_0, where it is first received by processor 14*a*, followed in turn by processors 14*b* and 14*c*. According to one embodiment, the controller 18 waits for the processors 14*a*-14*c* to be in synch before outputting the time delay instruction. Upon receiving the time delay instruction, each processor 14*a*-14*c* is configured to remove the time delay associated with its corresponding microphone 16*a*-16*c* and, with the exception of processor 14*c*, transmit the time delay instruction to the next processor in the processor chain 12. Once removed from the time delay instruction, the time delay for a given microphone 16*a*-16*c* can be stored to the third register R3 of the corresponding processor 14*a*-14*c*. Thus, referring to the time delay values calculated above, the value 0 would be stored to third register R3 of processor 14*a*, the value 35 would be stored to third register R3 of processor 14*b*, and the value 53 would be stored to third register R3 of processor 14*c*.

With respect to the embodiments described herein, the integer value of each time delay indicates a starting address block in the ring buffer 22 that is based on the current position of the write pointer and from which to begin reading sound samples. The starting address block for a given ring buffer 22 is determined by subtracting the integer value of the time delay from the current position of the write pointer. Referring again to the time delays calculated above for each microphone 16*a*-16*c*, and assuming that the current write pointer of each ring buffer 22 is positioned at address block 30 for illustrative purposes, the starting address block for the ring buffer 22 of processor 14*a* would be 30, the starting address block for the ring buffer 22 of processor 14*b* would be 251, and the starting address block for the ring buffer 22 of processor 14*c* would be 233.

Thus, it can be said that the time delay is responsible for setting the lag between the write pointer and the read pointer for the ring buffer 22 of each processor 14*a*-14*c*. Since each address block contains one sound sample, it can also be said that the integer value of a given time delay corresponds to a number of sound samples behind in time from the most recent sound sample written to the ring buffer 22. With respect to the above provided example, the starting address block for the ring buffer 22 of processor 14*a* is 0 sound samples behind whereas the starting address block for the ring buffers of processors 14*b* and 14*c* are 35 and 53 sound samples behind, respectively. If sampling at a rate of 20,000 samples per second, each ring buffer 22 will become full in 14.75 milliseconds and each sound sample, beginning with the most recent, goes back in time 0.05 milliseconds. Thus, when the starting address blocks for each ring buffer 22 is calculated, the read pointer for the ring buffer 22 of processor 14*a* points to the most recently stored sound sample going back in time 0.05 milliseconds whereas the read pointers for the ring buffers 22 of processors 14*b* and 14*c* point to older sound samples going back in time 1.75 milliseconds and 2.65 milliseconds, respectively.

Once the starting address blocks for the ring buffers 22 are determined, the corresponding sound samples can be read from each ring buffer 22 and are transferred over channel_1 from one processor to the next in the direction shown by arrows 36 until finally being received by the controller 18. In this configuration, it generally takes longer for the controller 18 to receive sound samples transmitted from processors in the processor chain 12 that are further located from the controller 18. To account for this, a distance can be added to each processor 14*a*-14*c* that is equal to the number of processors a given processor 14*a*-14*c* is away from the controller 18 multiplied by the quotient between the speed of sound and the sampling rate.

In addition to sound samples being transferred from one processor to the next, the sound samples read from the ring buffer 22 of one processor can be summed to the sound samples received from another processor to generate in-phase sound signals that are ultimately received by the controller 18. As described further below, summation can occur in one or more registers (e.g., register R1 and/or R2) of the associated processor and by virtue of the time delay equation provided above, each sound signal received by the controller 18 is phased according to microphone 16*a*, i.e., the microphone that is furthest located from the sound source 38.

Figure 4:
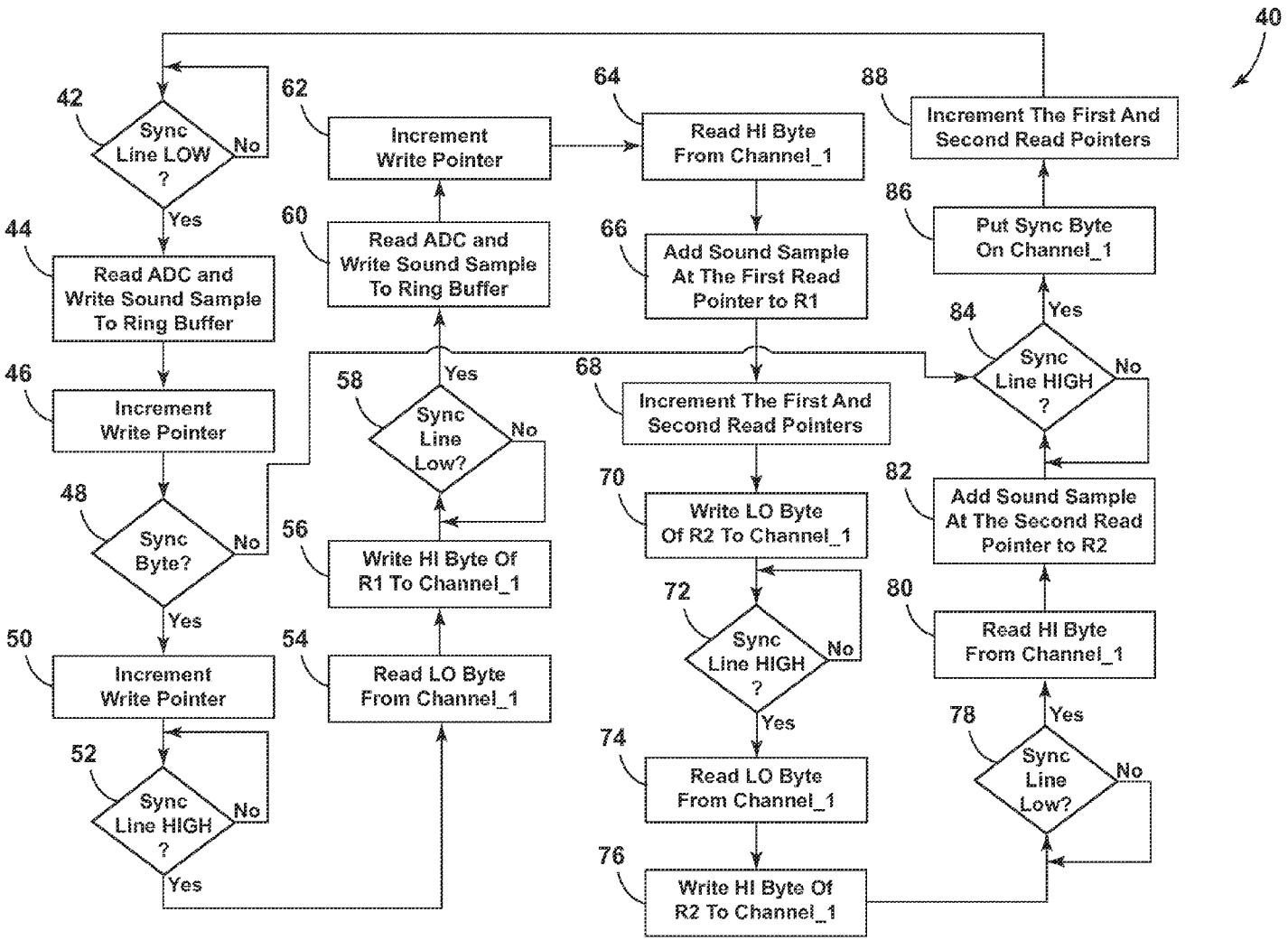
FIG. 4 is a flow diagram of a method for summing sound samples and is implemented using the sound gathering system shown in FIG. 3.

Referring to FIG. 4, a flow diagram for a method 40 of summing sound samples is shown and is exemplarily described herein as being implemented using the system 10 described previously in reference to FIG. 3. The method 40 includes multiple steps that are performed concurrently by each processor 14*a*-14*c*. These steps are dependent on a state of the sync line 32 and are represented in FIGS. 5-16 to provide a greater understanding of the method 40 provided herein. For clarity, some elements described previously in reference to FIG. 3 have been omitted or visually modified in FIGS. 5-16. In describing the method 40, it is assumed that each microphone 16*a*-16*c* samples at a rate of 20,000 samples per second and the ADC 20 of each processor 16*a*-16*c* provides 12-bit precision. It is also assumed that the system 10 has been operational long enough for the ring buffer 22 of each processor 14*a*-14*c* to have fully accumulated sound samples and the controller 18 has already determined the time delay for each microphone 16*a*-16*c*.

The method 40 can be performed cyclically, wherein a given cycle includes six phases, each of which is initiated by the sync line 32 turning either low or high. The method 40 is implemented using two read pointers for each ring buffer 22, wherein a first read pointer is used to read sound samples to the first register R1 and a second read pointer is used to read sound samples to the second register R2. The first register R1 and the second register R2 can each be configured as 16-bit registers to prevent data overflow when sound samples are summed together and are each divided into a low 8 bits (LO byte) and a high 8 bits (HI byte). Since each ring buffer 22 has two read pointers, it should be appreciated each processor 14*a*-14*c* may remove two time delays from the time delay instruction, a first time delay for setting the starting position of the first read pointer and a second time delay for setting the starting position of the second read pointer.

Figure 5:
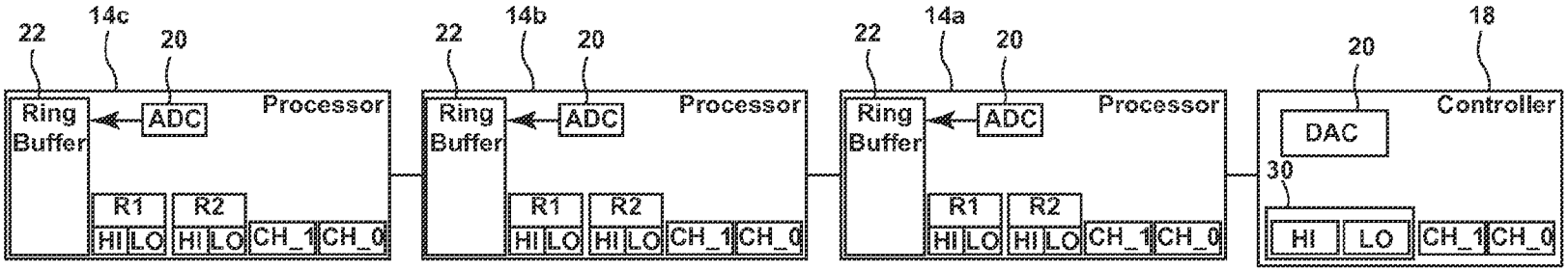
FIGS. 5-16 show the implementation of various steps of the method shown in FIG. 4.

The first phase begins at steps 42 and 44, wherein each processor 14*a*-14*c* reads its ADC 20 and writes the sound sample to the address block currently selected by the write pointer of the corresponding ring buffer 22 after the sync line 32 turns low, as shown in FIG. 5. The write pointer of each ring buffer 22 is then incremented in step 46 to select the next address block. With the exception of the last processor in the processor chain 12 (e.g., processor 14*c*), each remaining processor (e.g., processor 14*a* and 14*b*) reads channel_1 to check if a sync byte is present at step 48. In other words, processor 14*b* checks if it has received a sync byte from processor 14*c* and processor 14*a* checks if it has received a sync byte from processor 14*b*. If processors 14*b* and/or 14*a* have not received a sync byte, then the method 40 jumps to the sixth phase of the cycle where the sync byte(s) is placed on channel_1 once the sync line 32 turns high at steps 84 and 86. If on a subsequent pass-through, each processor 14*a*-14*c* increments the first and second read pointers of its corresponding ring buffer 22 at step 88 and returns to step 42 to start another pass-through. If on the first pass-through, step 88 can be skipped over since the positions of the first and second read pointers have yet to be established.

Referring back to step 46, once processors 14*b* and 14*a* have received a sync byte, then the processors 14*a*-14*c* are said to be in sync. If on a first pass-through, the controller 18 can now send out the time delay instruction so that each processor 14*a*-14*c* can determine the starting position for the first and second read pointers of their respective ring buffers 22. For a given processor 14*a*-14*c*, the starting position for the first read pointer of its ring buffer 22 can be determined by subtracting the time delay associated with its first register R1 from the current position of the write pointer. Likewise, the starting position for the second read pointer of its ring buffer 22 can be determined by subtracting the time delay associated with its second register R2 from the current position of the write pointer. Alternatively, if the time delay instruction was sent out in a previous pass-through, there is no need to send another one unless the location of the sound source 38 changes, which may require a new time delay instruction to be sent along with another determination of the starting positions for the first and second read pointers. In the present implementation, the time delays associated with first register R1 and second register R2 of a given processor 14*a*-14*c* are typically the same but may differ in other implementations.

Figure 6:
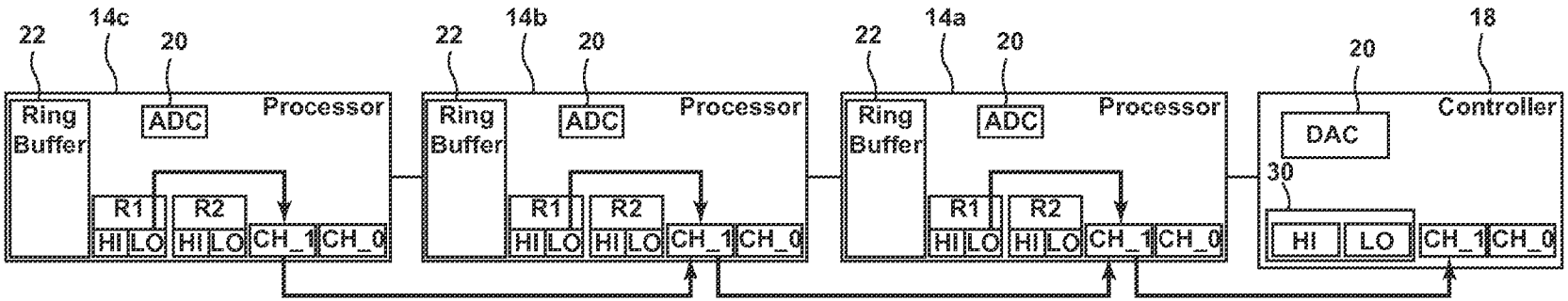

Now in sync, each processor 14*a*-14*c* writes the LO byte of its corresponding first register R1 to channel_1 at step 50. As shown in FIG. 6, processor 14*c* sends the LO byte of its corresponding first register R1 to processor 14*b*. At the same time, processor 14*b* sends the LO byte of its corresponding first register R1 to processor 14*a*. At the same time still, processor 14*a* sends the LO byte of its corresponding first register R1 to the controller 18. If on a first pass-through, the first register R1 of each processor 14*a*-14*c* can contain a default value, such as, but not limited to, a zero value. If on a subsequent pass-through, the first register R1 of processor 14*c* will contain a sound sample read previously from its own ring buffer 22 whereas the first register R1 of processors 14*b* and 14*a* will contain a sound sample received previously over channel_1 from processors 14*c* and 14*b*, respectively, and to which a sound sample is added from the corresponding ring buffer 22.

Figure 7:
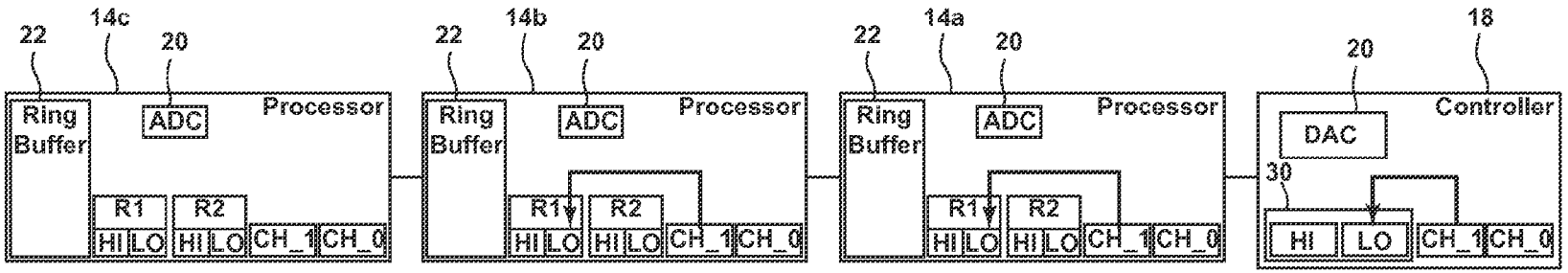
Figure 8:
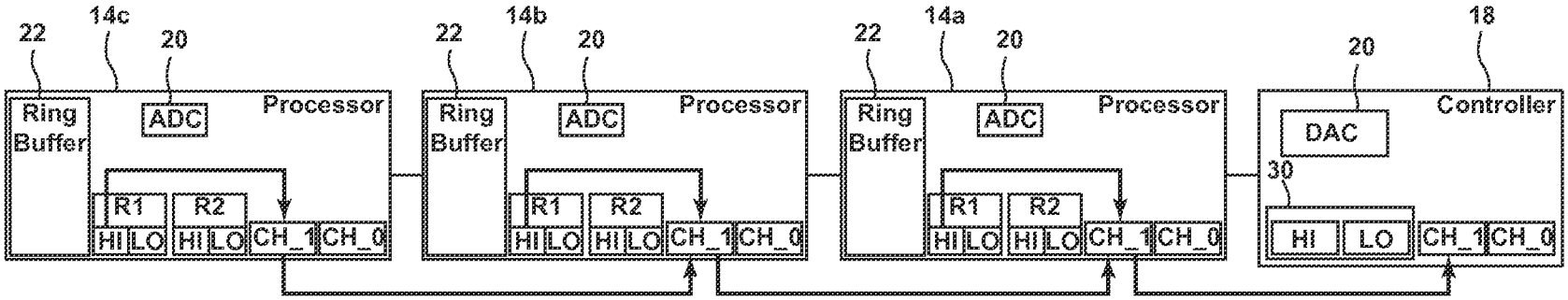

At steps 52 and 54, the LO bytes are read from channel_1 when the sync line 32 turns high, which commences the second phase of the cycle. As shown in FIG. 7, processor 14*b* transfers the LO byte received from processor 14*c* into its corresponding first register R1. At the same time, processor 14*a* transfers the LO byte received from processor 14*b* into its corresponding first register R1. At the same time still, the controller 18 transfers the LO byte received from processor 14*a* into its memory 30, which can be configured as a 16-bit register. Upon successfully receiving the LO bytes in processor 14*b*, processor 14*a*, and the controller 18, a similar transmittal process occurs for the HI byte of the first register R1 of each processor 14*a*-14*c*. At step 56, each processor 14*a*-14*c* writes the HI byte of its corresponding first register R1 to channel_1. As shown in FIG. 8, processor 14*c* sends the HI byte of its corresponding first register R1 to processor 14*b*. At the same time, processor 14*b* sends the HI byte of its corresponding first register R1 to processor 14*a*. At the same time still, processor 14*a* sends the HI byte of its corresponding first register R1 to the controller 18.

Figure 9:
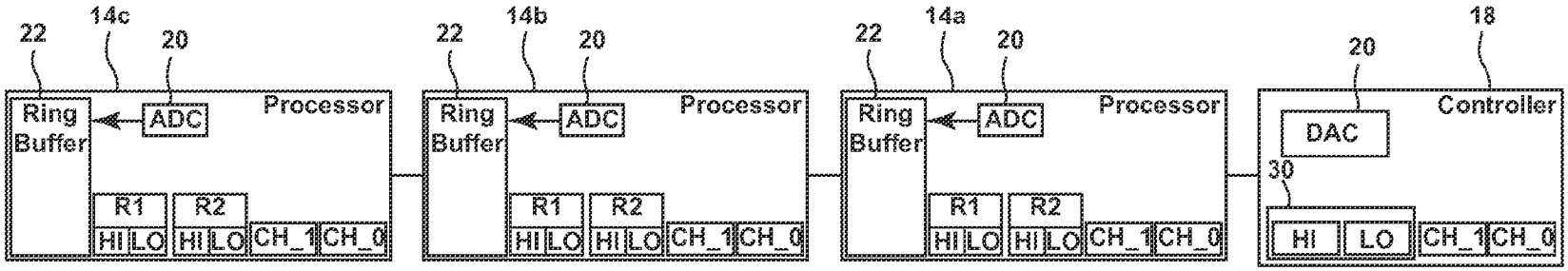
Figure 10:
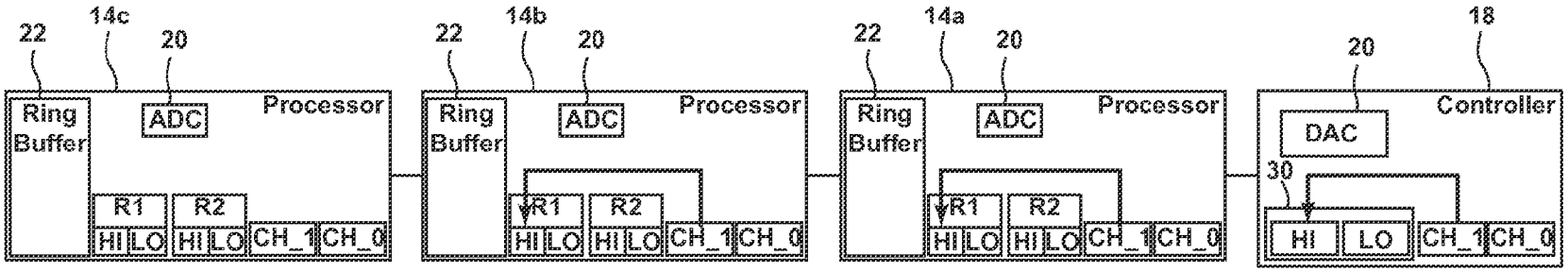

Upon completing step 56, the processors 14*a*-14*c* wait for the sync line 32 to turn low at step 58 to start of the third phase of the cycle. After the sync line 32 turns low, each processor 14*a*-14*c* reads the next sound sample from its ADC 20 and writes the sound sample to its ring buffer 22 at step 60 (FIG. 9). The write pointer is then incremented at step 62. At step 64, the HI bytes are read from channel_1 and stored in processor 14*b*, processor 14*a*, and the controller 18. As shown in FIG. 10, processor 14*b* transfers the HI byte received from processor 14*c* into its corresponding first register R1. At the same time, processor 14*a* transfers the HI byte received from processor 14*b* into its corresponding first register R1. At the same time still, the controller 18 transfers the HI byte received from processor 14*a* into its memory 30.

Figure 11:
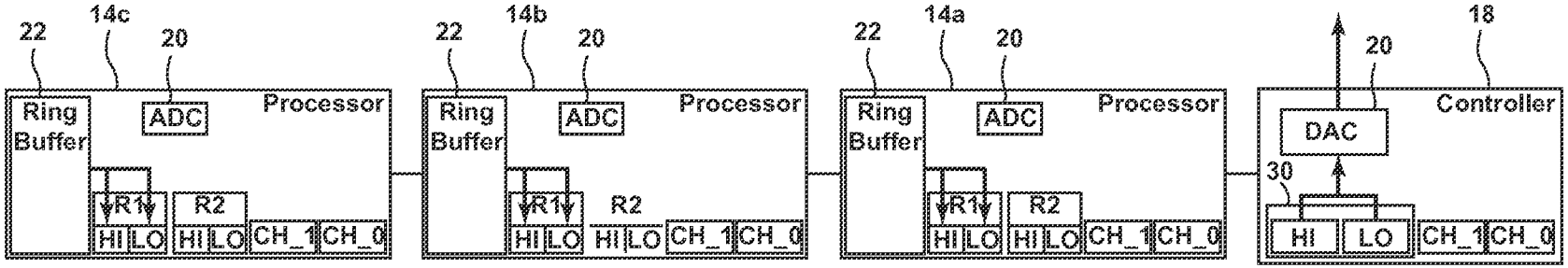

At this point, processors 14*b* and 14*a* will have each received 16 bits of data from processors 14*c* and 14*b*, respectively. Likewise, the controller 18 will have received 16 bits of data from processor 14*a*. At step 66, each processor 14*a*-14*c* reads its ring buffer 22 and transfers the sound sample at read pointer 1 to its first register R1 as shown in FIG. 11 before incrementing the first and second read pointers at step 68. With respect to processors 14*b* and 14*a*, the sound sample read from each of their ring buffers 22 is summed to the 16 bits of data currently stored in their first register R1*s*. Since processor 14*c* is last in the processor chain 12 and therefore does not receive sound samples over channel_1, processor 14*c* does not perform the abovementioned summation. At the completion of step 68, the new contents of the first register R1 of each processor 14*a*-14*c* are now ready to be written and read from channel_1 according to steps 50-64 during the next pass-through. Upon receiving the LO and HI bytes from first register R1 of processor 14*a*, the controller 18 can send the corresponding 16 bits of data to its DAC 28 to be converted into an analog signal, which can then be outputted to the speaker 37.

Figure 12:
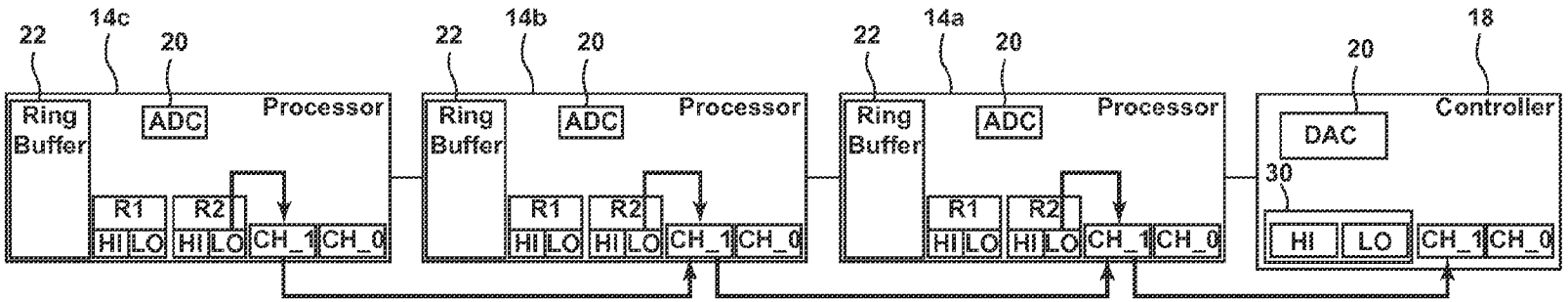

Next, at step 70, each processor 14*a*-14*c* writes the LO byte of its second register R2 to channel_1. As shown in FIG. 12, processor 14*c* sends the LO byte of its second register R2 to processor 14*b*. At the same time, processor 14*b* sends the LO byte of its second register R2 to processor 14*a*. At the same time still, processor 14*a* sends the LO byte of its second register R2 to the controller 18. If on a first pass-through, the second register R2 of each processor 14*a*-14*c* can contain a default value, such as, but not limited to, a zero value. If on a subsequent pass-through, the second register R2 of processor 14*c* will contain a sound sample read previously from its own ring buffer 22 whereas the second register R2 of processors 14*b* and 14*a* will contain a sound sample received previously over channel_1 from processors 14*c* and 14*b*, respectively, and to which a sound sample is added from the corresponding ring buffer 22.

Figure 13:
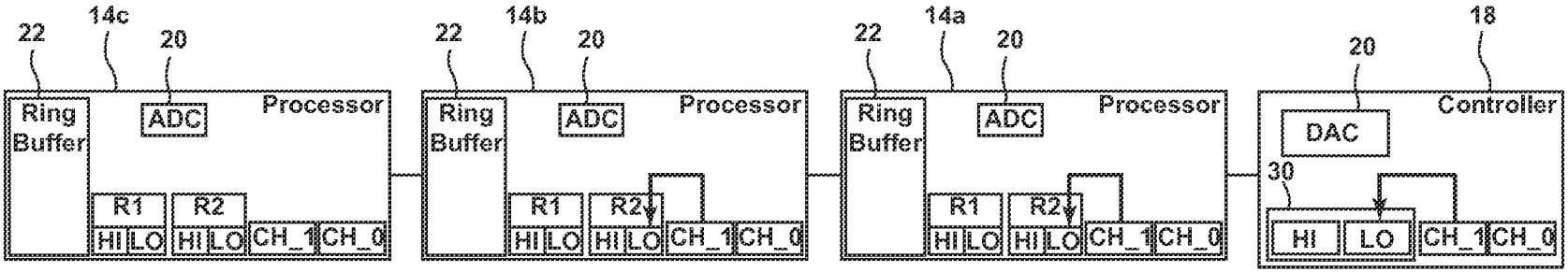
Figure 14:
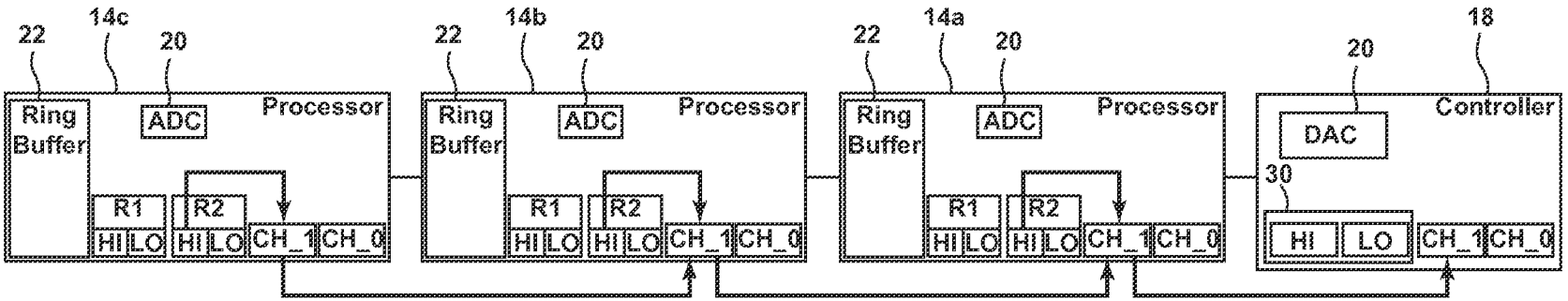

The fourth phase of the cycle begins when the sync line 32 turns high at step 72, at which time the LO bytes are read from channel_1 at step 74. As shown in FIG. 13, processor 14*b* transfers the LO byte received from processor 14*c* into its second register R2. At the same time, processor 14*a* transfers the LO byte received from processor 14*b* into its second register R2. At the same time still, the controller 18 transfers the LO byte received from processor 14*a* into its memory 30. Next, at step 76, each processor 14*a*-14*c* writes the HI byte of its second register R2 to channel_1. As shown in FIG. 14, processor 14*c* sends the HI byte of its second register R2 to processor 14*b*. At the same time, processor 14*b* sends the HI byte of its second register R2 to processor 14*a*. At the same time still, processor 14*a* sends the HI byte of its second register R2 to the controller 18.

Figure 15:
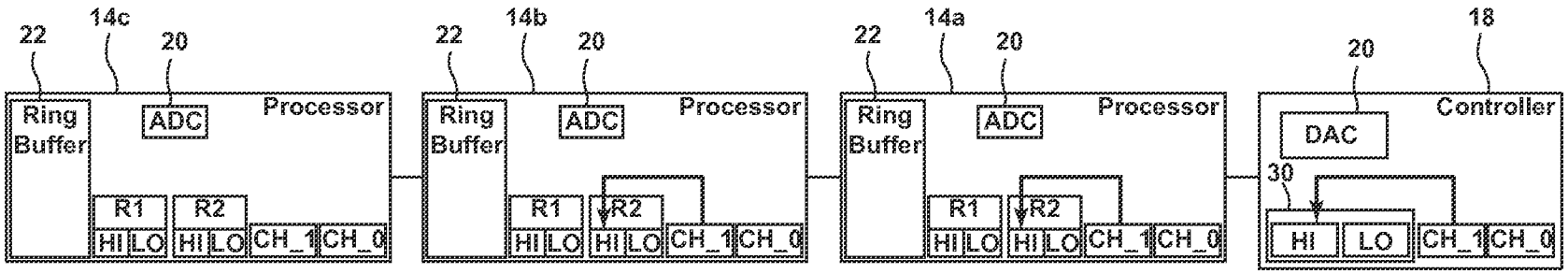

The fifth phase begins after the sync line 32 turns low at step 78, at which time the HI bytes are read from channel_1 at step 80. As shown in FIG. 15, processor 14*b* transfers the HI byte received from processor 14*c* into its second register R2. At the same time, processor 14*a* transfers the HI byte received from processor 14*b* into its second register R2. At the same time still, the controller 18 transfers the HI byte received from processor 14*a* into its memory 30.

Figure 16:
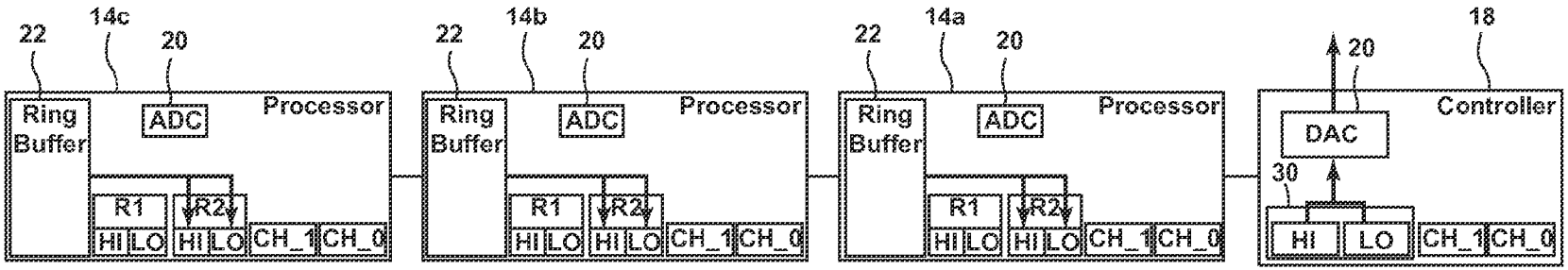

Upon completing step 80, processors 14*b* and 14*a* will have each received 16 bits of data from processors 14*c* and 14*b*, respectively. Likewise, the controller 18 will have received 16 bits of data from processor 14*a*. At step 82, each processor 14*a*-14*c* reads its ring buffer 22 and transfers the sound sample at the second read pointer to its second register R2, as shown in FIG. 16. With respect to processors 14*b* and 14*a*, the sound sample read from each of their ring buffers 22 is summed to the 16 bits of data currently stored in their second register R2*s*. Since processor 14*c* is last in the processor chain 12 and therefore does not receive data over channel_1 from either processor 14*b* or processor 14*a*, processor 14*c* does not perform the abovementioned summation. At the completion of step 82, the new contents of the second register R2 of each processor 14*a*-14*c* are now ready to be written and read from channel_1 according to steps 70-80 during the next pass-through. Once the controller 18 has received the LO and HI bytes from the second register R2 of processor 14*a*, the corresponding 16 bits of data can be converted into an analog signal by DAC 28 and outputted to the speaker 37. Finally, the processors 14*a*-14*c* wait for the sync line 32 to turn high at step 84 before commencing the sixth phase, which was outlined previously herein. Completion of the sixth phase ends the current pass-through and another pass-through can begin once more at step 42.

Accordingly, for every pass-through of the method 40, the ADC 20 of each processor 14*a*-14*c* is read twice while only one signal associated with the use of the first registers R1 is outputted to the speaker 37 and only one signal associated with the use of the second registers R2 is outputted to the speaker 37. By operating the ADCs 20 in this manner, a finer granularity can be achieved. While the method 40 has been described herein as being implemented using two registers R1, R2, it should be appreciated that a single register or more than two registers can be used in other embodiments.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A sound gathering system comprising:

a plurality of microphones, each configured to sample sound coming from a sound source;

a processor chain having a plurality of processors, each coupled to at least one of the microphones and each configured to store sound samples received from the at least one microphone to a memory; and a controller terminally connected to the processor chain via a first processor, the controller configured to calculate at least one time delay for each microphone, wherein the at least one time delay for each microphone is provided to the processor coupled thereto and is used by the processor to determine a memory position from which to begin reading sound samples.

2. The sound gathering system of claim 1, wherein each time delay is packaged in a time delay instruction that is sent over a first channel to each processor in the processor chain, beginning with the first processor and ending with a last processor.

3. The sound gathering system of claim 2, wherein each processor, beginning with the first processor, removes in order the at least one time delay associated with the microphone coupled thereto from the time delay instruction.

4. The sound gathering system of claim 3, wherein with the exception of the last processor, each remaining processor adds a sound sample read from memory to a sound sample received over a second channel from another processor.

5. The sound gathering system of claim 1, wherein the memory of each processor comprises a ring buffer having a predetermined length and wherein the memory position from which to begin reading sound samples is determined by subtracting an integer value of the at least one time delay from a current write pointer position of the ring buffer.

6. The sound gathering system of claim 1, wherein the time delay for a given microphone is calculated based on the distance between the sound source and the microphone located furthest from the sound source; the distance between the sound source and the given microphone; the sampling rate of the given microphone; and the speed of sound.

7. The sound gathering system of claim 6, wherein the time delay for the microphone located furthest from the sound source has a time delay of zero and the time delays for the remaining microphones increase the closer the microphones are to the sound source.

8. The sound gathering system of claim 1, wherein the sound samples read from each memory are phased according to the microphone located furthest from the sound source.

9. A sound gathering system comprising:

a plurality of microphones, each configured to sample sound coming from a sound source;

a processor chain having a plurality of processors, each coupled to at least one of the microphones and each configured to store sound samples received from the at least one microphone to a memory; and a controller terminally connected to the processor chain via a first processor, the controller configured to generate a time delay instruction containing a plurality of time delays that are each associated with one of the microphones;

wherein the time delay instruction is provided to each of the processors over a first channel;

wherein each processor removes at least one time delay from the time delay instruction and determines a memory position from which to begin reading sound samples based on the at least one time delay; and wherein the sound samples read from the memory of each processor are summed together over a second channel to generate in-phase signals that are sent to the controller.

10. The sound gathering system of claim 9, wherein with the exception of a last processor in the processor chain, each remaining processor adds a sound sample read from memory to a sound sample received over a second channel from another processor.

11. The sound gathering system of claim 9, wherein the memory of each processor comprises a ring buffer having a predetermined length and wherein the memory position from which to begin reading sound samples is determined by subtracting an integer value of the at least one time delay from a current write pointer position of the ring buffer.

12. The sound gathering system of claim 9, wherein the time delay for a given microphone is calculated based on the distance between the sound source and the microphone located furthest from the sound source; the distance between the sound source and the given microphone; the sampling rate of the given microphone; and the speed of sound.

13. The sound gathering system of claim 12, wherein the time delay for the microphone located furthest from the sound source has a time delay of zero and the time delays for the remaining microphones increase the closer the microphones are to the sound source.

14. The sound gathering system of claim 9, wherein the sound samples read from each memory are phased according to the microphone located furthest from the sound source.

15. A method of gathering sound comprising the steps of:

sampling sound coming from a sound source using a plurality of microphones;

arranging a plurality of processors in a processor chain, each processor coupled to at least one of the microphones and each configured to store sound samples received from the at least one microphone to a memory;

terminally connecting a controller to the processor chain via a first processor and using the controller to generate a time delay instruction containing a plurality of time delays that are each associated with one of the microphones;

providing the time delay instruction to each of the processors over a first channel;

removing with each processor at least one time delay from the time delay instruction and determining a memory position from which to begin reading sound samples based on the at least one time delay; and summing together sound samples read from the memory of each processor over a second channel to generate in-phase signals that are sent to the controller.

16. The method of claim 15, wherein with the exception of a last processor in the processor chain, each remaining processor adds a sound sample read from memory to a sound sample received over a second channel from another processor.

17. The sound gathering system of claim 15, wherein the memory of each processor comprises a ring buffer having a predetermined length and wherein the memory position from which to begin reading sound samples is determined by subtracting an integer value of the at least one time delay from a current write pointer position of the ring buffer.

18. The sound gathering system of claim 15, further comprising the step of calculating the time delay for a given microphone based on the distance between the sound source and the microphone located furthest from the sound source; the distance between the sound source and the given microphone; the sampling rate of the given microphone; and the speed of sound.

19. The sound gathering system of claim 18, wherein the time delay for the microphone located furthest from the sound source has a time delay of zero and the time delays for the remaining microphones increase the closer the microphones are to the sound source.

20. The sound gathering system of claim 15, wherein the sound samples read from each memory are phased according to the microphone located furthest from the sound source.

* * * * *